US005965971A

United States Patent [19]

Karpov

[11] Patent Number: 5,965,971

[45] Date of Patent: Oct. 12, 1999

[54] EDGE EMITTER DISPLAY DEVICE

[75] Inventor: Leonid Danielovich Karpov, Austin, Tex.

[73] Assignee: Kypwee Display Corporation, Austin, Tex.

[21] Appl. No.: 08/491,917

[22] PCT Filed: Dec. 15, 1993

[86] PCT No.: PCT/RU93/00305

§ 371 Date: Jul. 18, 1995

§ 102(e) Date: Jul. 18, 1995

[87] PCT Pub. No.: WO94/17546

PCT Pub. Date: Aug. 4, 1994

[30] Foreign Application Priority Data

Jan. 19, 1993 [RU] Russian Federation ..... 93003280
Aug. 13, 1993 [RU] Russian Federation ..... 93041195

[51] Int. Cl.[6] ..... H01J 01/02; H01J 01/16; H01J 19/10; H01J 01/62

[52] U.S. Cl. ..... 313/309; 313/336; 313/351; 313/495; 313/496

[58] Field of Search ..... 313/309, 336, 313/351, 308, 331, 358, 495–497, 511–512, 500, 505–506, 507, 503, 311–312, 306–307, 502, 508–509

[56] References Cited

U.S. PATENT DOCUMENTS

| | | | |
|---|---|---|---|
| 3,665,241 | 5/1972 | Spindt et al. . | |
| 3,671,798 | 6/1972 | Lees . | |
| 3,755,704 | 8/1973 | Spindt et al. . | |
| 3,789,471 | 2/1974 | Spindt et al. . | |
| 3,840,955 | 10/1974 | Hagood et al. . | |
| 3,921,022 | 11/1975 | Levine . | |
| 4,307,507 | 12/1981 | Gray et al. . | |
| 4,638,334 | 1/1987 | Burnham . | |
| 4,721,885 | 1/1988 | Brodie | 313/576 |
| 4,728,851 | 3/1988 | Lambe | 313/309 |

(List continued on next page.)

FOREIGN PATENT DOCUMENTS

| | | | |
|---|---|---|---|
| 0443865 | 8/1991 | European Pat. Off. . | |
| 0501785 | 2/1992 | European Pat. Off. . | |
| 0493804 | 7/1992 | European Pat. Off. | H01J 31/12 |
| 0495227 | 7/1992 | European Pat. Off. | H01J 9/02 |
| 0535953 | 4/1993 | European Pat. Off. | H01J 1/30 |
| 4010909 | 10/1991 | Netherlands . | |
| 2259183 | 3/1993 | United Kingdom . | |
| 2259184 | 3/1993 | United Kingdom . | |
| 9105363 | 4/1991 | WIPO | H01J 19/24 |
| 9107771 | 5/1991 | WIPO | H01J 9/02 |
| 9112625 | 8/1991 | WIPO | H01J 1/46 |

OTHER PUBLICATIONS

PCT Search Report dated May 10, 1994.

Akinwande, et al., "Lateral Thin–Film–Edge Emitter Vacuum Transistors", Technical Digest, Jul. 12–15, 1993, pp. 12–13.

Legg et al., "Improved Monolithic Vacuum Field Emission Diodes", J.Vac.Sci.Technol. B, Mar./Apr. 1994, pp. 666–671.

Vecht, et al., "New Electron Excited Light Emitting Materials", J.Vac.Sci.Technol. B, Mar./Apr. 1994, pp. 781–784.

(List continued on next page.)

*Primary Examiner*—Sandra O'Shea
*Assistant Examiner*—Mack Haynes
*Attorney, Agent, or Firm*—Baker & Botts, L.L.P.

[57] ABSTRACT

An edge emitter display device is provided comprising an anode (1) and a cathode (2). Cathode (2) is situated at a level above and laterally displaced from anode (1), providing an opening for a window above anode (1). Cathode (2) has an emitting edge (4) which is operable to emit field electrons when a positive voltage is applied to anode (1) with respect to cathode (2). A phosphor layer is disposed above anode (1) and below the level of cathode (2) and is operable to luminesce when struck with the electrons emitted from the emitting edge (4).

36 Claims, 8 Drawing Sheets

U.S. PATENT DOCUMENTS

| | | | |
|---|---|---|---|
| 4,827,177 | 5/1989 | Lee et al. | 313/306 |
| 4,901,028 | 2/1990 | Gray et al. . | |
| 4,956,574 | 9/1990 | Kane . | |
| 4,964,946 | 10/1990 | Gray et al. . | |
| 4,987,377 | 1/1991 | Gray . | |
| 5,004,956 | 4/1991 | Kun et al. . | |
| 5,007,873 | 4/1991 | Goronkin et al. . | |
| 5,030,895 | 7/1991 | Gray . | |
| 5,030,921 | 7/1991 | Kane . | |
| 5,075,595 | 12/1991 | Kane . | |
| 5,079,476 | 1/1992 | Kane . | |
| 5,127,990 | 7/1992 | Pribat et al. | 156/644 |
| 5,129,850 | 7/1992 | Kane et al. . | |
| 5,136,764 | 8/1992 | Vasquez . | |
| 5,138,237 | 8/1992 | Kane et al. . | |
| 5,138,397 | 8/1992 | Kun et al. . | |
| 5,140,219 | 8/1992 | Kane . | |
| 5,141,459 | 8/1992 | Zimmerman | 445/24 |
| 5,141,460 | 8/1992 | Jaskie et al. . | |
| 5,142,184 | 8/1992 | Kane . | |
| 5,142,256 | 8/1992 | Kane . | |
| 5,144,191 | 9/1992 | Jones et al. | 313/308 |
| 5,148,078 | 9/1992 | Kane . | |
| 5,150,192 | 9/1992 | Green et al. . | |
| 5,155,420 | 10/1992 | Smith . | |
| 5,157,304 | 10/1992 | Kane et al. . | |
| 5,157,309 | 10/1992 | Parker et al. . | |
| 5,166,709 | 11/1992 | Kubelick . | |
| 5,173,634 | 12/1992 | Kane . | |
| 5,173,697 | 12/1992 | Smith et al. . | |
| 5,180,951 | 1/1993 | Dworsky et al. . | |
| 5,203,731 | 4/1993 | Zimmerman | 445/24 |
| 5,214,346 | 5/1993 | Komatsu . | |
| 5,214,347 | 5/1993 | Gray | 313/355 |
| 5,233,263 | 8/1993 | Cronin et al. | 313/309 |
| 5,243,252 | 9/1993 | Kaneko et al. . | |
| 5,252,895 | 10/1993 | Leksell . | |
| 5,258,685 | 11/1993 | Jaskie et al. | 313/309 |
| 5,266,155 | 11/1993 | Gray | 156/651 |
| 5,277,638 | 1/1994 | Lee et al. . | |
| 5,278,475 | 1/1994 | Jaskie et al. | 315/169.3 |
| 5,281,890 | 1/1994 | Kane . | |
| 5,289,086 | 2/1994 | Kane . | |
| 5,290,610 | 3/1994 | Kane et al. | 427/577 |
| 5,300,862 | 4/1994 | Parker et al. . | |
| 5,301,554 | 4/1994 | Kane . | |
| 5,308,439 | 5/1994 | Cronin et al. | 156/656 |
| 5,312,777 | 5/1994 | Cronin et al. . | |
| 5,313,140 | 5/1994 | Smith et al. . | |
| 5,319,233 | 6/1994 | Kane . | |
| 5,320,570 | 6/1994 | Kane . | |
| 5,341,063 | 8/1994 | Kumar | 313/309 |
| 5,382,185 | 1/1995 | Gray et al. | 445/49 |
| 5,382,867 | 1/1995 | Maruo et al. . | |
| 5,386,172 | 1/1995 | Komatsu | 313/309 |
| 5,397,957 | 3/1995 | Zimmerman | 313/309 |
| 5,445,550 | 8/1995 | Xie et al. . | |
| 5,448,133 | 9/1995 | Ise . | |
| 5,458,520 | 10/1995 | DeMercurio et al. . | |
| 5,489,933 | 2/1996 | Betsui et al. . | |
| 5,519,414 | 5/1996 | Gold et al. . | |
| 5,520,563 | 5/1996 | Wallace et al. . | |
| 5,525,857 | 6/1996 | Gnode . | |
| 5,536,193 | 7/1996 | Kumar . | |
| 5,537,001 | 7/1996 | Clerc . | |
| 5,543,684 | 8/1996 | Kumar et al. . | |
| 5,547,483 | 8/1996 | Garcia et al. . | |
| 5,558,732 | 9/1996 | Hamon . | |
| 5,574,333 | 11/1996 | Clerc . | |
| 5,604,399 | 2/1997 | Potter et al. . | |
| 5,612,728 | 3/1997 | Kun et al. . | |
| 5,614,785 | 3/1997 | Wallace et al. . | |
| 5,616,061 | 4/1997 | Potter | 445/24 |
| 5,618,216 | 4/1997 | Potter | 445/24 |
| 5,628,663 | 5/1997 | Potter | 445/49 |
| 5,629,579 | 5/1997 | Zimmerman | 313/309 |
| 5,629,580 | 5/1997 | Mandelman et al. . | |
| 5,630,741 | 5/1997 | Potter | 445/24 |
| 5,633,560 | 5/1997 | Huang . | |
| 5,644,188 | 7/1997 | Potter | 313/309 |
| 5,644,190 | 7/1997 | Potter | 313/336 |
| 5,647,998 | 7/1997 | Potter | 216/24 |
| 5,666,019 | 9/1997 | Potter | 313/306 |
| 5,669,802 | 9/1997 | Potter | 445/24 |
| 5,700,176 | 12/1997 | Potter . | |
| 5,703,380 | 12/1997 | Potter | 257/10 |

OTHER PUBLICATIONS

Chakhovskoi et al., Phosphor Selection Constraints in Application of Gated Field–Emission Microcathodes to Flat Panel Displays, J. Vac. Sci. Technol. B. (12(2), 1994, pp. 785–789.

Baptist, R., "Microtips fluorescent displays," *L'Onde Electrique*, vol. 71 –N°6, (1991) p. 36–42.

Busta, H.H, et al., "Lateral Miniaturized Vacuum Devices," *IEEE*, (1989) IEDM 89–533 –89–536, pp. 20.4.1 –20.4.4.

Ghis, A., et al., "Sealed Vacuum Devices: Fluorescent Microtip Displays," *IEEE Transactions on Electron Devices*, vol. 38, No. 10 (Oct. 1991) pp. 2320–2322).

Gray, H.F. et al., "Film Edge Emitters: The Basis for a New Vacuum Transistor," *IEEE*, (1991) 201–IEDM –204–IEDM, pp. 8.2.1. –8.2.4.

Itoh, J. et al., "Fabrication and Characterization of Comb–Shaped Lateral Field–Emitter Arrays," *Jpn. J. Appl. Phys.*, vol. 32 (1993) pp. 1221–1226.

Itoh, J. et al., "Low–Operation–Voltage Comb–Shaped Field Emitter Array," *Jpn. J. Appl. Phys.*, vol. 31 (1992) pp. L884–L886.

Itoh, J. et al., "Vacuum Microtriode with Comb–Shaped Lateral Field–Emitter Array," *Jpn. J. Appl. Phys.*, vol. 32 (1993) pp. L809–L812.

Kaneko, A., et al., "Wedge–Shaped Field Emitter Arrays for Flat Display," *IEEE Transactions on Electron Devices*, vol. 38, No. 10 (Oct. 1991) pp. 2395–2397.

Kanemaru, S. and J. Itoh, "Fabrication and Characterization of Lateral Field–Emitter Triodes," *IEEE Transactions on Electron Devices*, vol. 38, No. 10 (Oct. 1991) pp. 2334–2336.

EDGE EMITTER DISPLAY DEVICE

BACKGROUND OF INVENTION

1. Field of Invention

The invention relates in general to electronics and more specifically to an edge emitter display device, having particular reference to data display devices for use as a screen or display, as well as use in vacuum-tube microelectronics as super-high speed heat-and-radiation resistant devices.

2. Description of Prior Art

Known in the present state of the art is a cathode-luminescent display (cf. L'Onde Electrique, Novembre-Decembre 1991, Vol. 71, No. 6, pp. 36–42), comprising an array source of electrons and a screen situated above the surface of the source of electrons and electrically insulated from it.

The source of electrons is in fact a substrate, on which ribbon-type cathodes (arranged in columns) and gates (arranged in rows) are provided. The columns and rows are separated from one another by a dielectric layer and intersect one another. Holes are provided at the places of intersection of the ribbon-type gates (or rows) and the dielectric layer, and the holes are adapted to accept needle-type emitters whose bases are situated either directly on the ribbon-type cathode (or column) or on the layer of a load resistor applied to the ribbon-type cathodes. The tips of the needle emitters are at the level of the edges of the holes in the ribbon-type gates (or rows).

Since a display (monitor) can be either monochrome or color. A monochrome display is essentially a transparent plate on which a transparent electrically conducting coating is deposited; i.e., the first coating appearing as parallel electrodes performing the function of cathode buses (columns), and the second coating appearing as parallel electrodes performing the function of grid buses (rows), and a phosphor layer. A color display on a transparent electrically conducting layer has green, red, and blue-emitting areas of the phosphor layer, which are brought in coincidence with the areas established by the places of crossover of the ribbon-type cathodes and gates. Both the display and the source of electrons are enclosed in common air-evacuated casing.

A 400 volt constant positive voltage is applied to the display with respect to the ribbon-type cathodes, while a 50 to 80 volt constant positive voltage is applied to the ribbon-type gates with respect to the ribbon-type cathodes. In a single element or pixel cell of such an arrangement, the operation proceeds in the following manner.

Due to a short spacing between the edge of a hole in the ribbon-type gate and the tip of a needle-type emitter (i.e., of the order of 0.4–0.5 $\mu$m), a high-intensity (in excess of $10^7$ volts per centimeter or V/cm) electric field is established at the emitter tip, and field emission of electrons from the emitter tip begins. The emitted electrons come under the effect of the accelerating electric field of the display and, while flying towards the display, the electrons bombard the phosphor, thus causing it to luminesce.

Each element (pixel) located at the crossover of the ribbon-type gate and the ribbon-type cathode provides for glow of a dot on the display. Thus, a monochrome or color picture can be established on the display by consecutively activating the respective ribbon-type gates with respect to the respective ribbon-type cathodes with a definite switch-over time.

This type of cathodoluminescent display is characterized by high voltages (that is, 400–500V) applied to the display, which results in higher power consumption which affects the operating stability and dependability of the display. During operation under the bombarding effect of the ions of the residual gases, emitter tips change geometry and undergo an increased radius of curvature which results in the lower operating stability. Ionization activity of any residual gas may occur due to a high voltage (400–500V) applied to the display and an adequately large spacing (200 $\mu$m) between the tips of the emitters and the display surface. Such an increase in the radius of curvature of the emitter tips decreases the intensity of the electric field at the tips, and the field emission current is reduced, causing a resultant lower phosphor surface brightness. Such displays have but a short service life, usually not exceeding 9000 hours. Due to an increased risk of electrical breakdown between the display and the source of electrons at high anode voltages, these types of displays have had lower dependability.

Moreover, production techniques for such displays are complicated and expensive due to a sophisticated process of forming submicron-size emitting cells. These displays thus are expensive, which discourages production of cathodoluminescent displays measuring 200×200 mm and over.

Known in the art is another device, comprising a wedge-shaped array of field emitters and an anode positioned above the array surface (cf Wedge-shaped field emitter array for flat display, Kaneko A., Kanno T., Tomi K., Kitagawa M., and Hiraqi T. T. T. IEEE Trans Electron Devices, 1991, V. 38, No. 10, 2395–2397).

The field-emitter array in such a device is in fact a dielectric substrate, provided with parallel rows of ribbon-type aluminum cathodes and parallel rows of ribbon-type chromium gates. The rows of cathodes and of anodes intersect one another and are separated by a dielectric layer. Chromium-film emitters are provided at the places of intersection of the rows, being applied to an aluminum layer so as to form a bilateral saw-tooth pattern.

A gate is provided on the dielectric layer, having openings following the outline of the pattern of the emitters along the entire perimeter thereof with a gap of 1 $\mu$m. The plane of the gate is located about 250 nm over the plane of the film emitters. The emitting surface is in effect the edge of the end face of a film emitter throughout the perimeter of the saw-tooth pattern.

The anode is essentially a glass transparent plate, having a transparent electrically conducting coating and a phosphor coating applied to its surface. The anode is spaced a few millimeters apart from the surface of the field-emitter array, and the device is hermetically sealed and air is evacuated therefrom.

At a typical one of the intersections of the rows of ribbon-type cathodes and ribbon-type gates, the operation is as follows. A 300 V constant positive voltage is applied to the anode with respect to the ribbon-type cathode, and a 50 to 80 V constant positive voltage is applied to the ribbon-type gate with respect to the ribbon-type cathode. Due to a short spacing between the edge of emitter end face and the edge of the gate hole (that is, about 1 $\mu$m), a high-intensity electric field is established at the edge of the emitter end face. Field emission of electrons from the edge of the emitter is thus established. The emitted electrons come under the effect of the accelerating electric field of the anode flying towards the anode and bombarding the phosphor to cause it to luminesce. A picture can be created on the display by consecutively turning on the respective ribbon-type gates with the respective ribbon-type cathodes with a definite switch-over time.

This device features high anode voltage (+300V) and a low working pressure of residual gases. An adequately high anode voltage must be applied in order that the majority of the emitted electrons are in the anode circuit rather than in the gate circuit, and also to cause an effective phosphor luminescence, since it is seen against a light background, that is, from an anode surface devoid of phosphor.

A low pressure of the residual gases is necessary to reduce the danger of ionization of the residual gas in the space confined between the anode and the field-emitter array. Gas ionization is very much likely due to the spacing (a few millimeters) between the anode and the array. However, a low residual gas pressure is difficult to maintain in the devices during prolonged operation, due to gas entry from the surrounding atmosphere and gas coming from the structural components inside the hermetically sealed casing of the device.

Due to increased pressure in the interior of the device as time passes, high anode voltage, and large spacing between the anode and the array of the field-emission cathodes, the molecules of residual gas are ionized in the anode-to-array space. The ions so produced bombard the emitting edge of the emitter end face, thus increasing the radius of curvature of the edge. As a result, the intensity of the electric field at the edge is decreased and the magnitude of field-emission current is reduced. Furthermore, the phosphor luminance at any set voltage level is reduced, and the device thus features a low working stability over time in use. In addition, the device in question fails to provide a high-resolution (15–20 lines/mm) picture, due to a defocusing of electron beams, and also produces a harmful radiation effect due to a relatively high anode voltage.

Known in the art presently is a vacuum diode (U.S. Pat. No. 3,789,471) which comprises a substrate carrying an electrically conducting layer, and a dielectric layer carried by the electrically conducting layer and provided with a window with a cone-shaped cathode located in the window. The cathode has its base electrically contacting the conducting layer, while the tip of the emitter is at the level of another conducting layer located on the dielectric layer. The second conducting layer has a window as well, which is in register with the window of the dielectric layer. An anode is located on the conducting layer so as to hermetically seal the evacuated space established by the windows in the dielectric layer and the second conducting layer. A positive voltage is applied to the anode with respect to the cathode, and due to a short spacing between the anode and the cathode tip produces, a high-intensity electric field at the cathode tip. As a result, a field emission of electrons starts from the cathode towards the anode, and an electric current results in its circuit. Such a device can find application as a heat-and-radiation-resistant diode. The device is, however, disadvantageous in having a low time-dependent working stability, which is accounted for by the bombarding effect produced by the ions of residual gases, with the resultant increased radius of curvature of the cathode. The electric field intensity at the cathode tip thus diminishes and hence the field-emission current in the anode circuit decreases.

The above processes proceed most efficiently at a small radius of curvature of the cathode tip, while the construction of the device prevents an efficient degassing of the evaluated space by heating because the space is confined. Moreover, the materials of the vacuum diode differ in their coefficients of linear expansion, and the choice of such materials is limited by production techniques, which are very complicated and are in turn responsible for a high cost of the device.

Known in the art also is a field-emission diode (cf. Fabrication of Lateral Triode with Comb-Shaped Field-Emitter Arrays, by Junji Itoh, Kazunari Vishiki, and Kazuhiki Tsuburaya, Proceedings of the International Conference on Vacuum Microelectronics, 1993, Newport USA, pp. 99–100).

The device comprises a dielectric substrate, a film cathode (emitter), a gate, and a film anode. The gate (that is, a layer of an electrically conducting material) is located in a recess provided in the substrate between the anode and the cathode. A positive voltage (with respect to the cathode) is applied to the anode, and a positive voltage (with respect to the cathode) is applied to the gate, creating a high-intensity electric field at the edge of the cathode to establish field emission of electrons towards the end face of the anode, whereby an electric current arises in the anode circuit.

One of the disadvantages inherent in this device resides in a low operating dependability and stability due to a necessity for application of a rather high anode voltage (i.e., about 150V). This in turn adds to the danger of ionization of the residual gas molecules, while the resultant ions bombard the cathode edge, thereby changing the edge geometry and hence increasing the spacing between the anode and the edge of the cathode. As a result, the electric field intensity at the cathode edge decreases, as well as the field emission current. The risk of ionization of the residual gas molecules is also rather high in this device, due to a large distance between the emitter edge and the anode end face. Bringing the anode end face nearer to the cathode edge is a very difficult task, because the gate is interposed between the anode and cathode. Hence, an adequately high vacuum is needed for operation of the device. Because electrons are bombarding only the anode end face the device is of low dependability and it might become considerably heated and destroyed, due to high densities of the electron flow. In addition, since the electron flow does not spread over the entire surface, the device features limited functional capabilities; that is, its field of application is much restricted. Since the device requires rather high gate voltages (up to 110V) and anode voltages (up to 150V), the device consumes much power, and is disadvantageous in this respect. Also, the high voltages applied cause an increased danger of electric breakdown between the electrodes, e.g., between the cathode edge and the gate. This type of device is of low operating dependability and stability, especially under conditions of industrial vacuum, is uneconomic as to power consumption, and has but a restricted field of application.

SUMMARY OF INVENTION

It is a primary object of the present invention to provide a field-emission device capable, due to a change in the direction of the electron flow, of reducing considerably power consumption, increasing its operating dependability, and extending much its functional capabilities.

The foregoing object is accomplished due to the fact that in a field-emission device according to the invention, comprising an anode and a cathode, both placed on a substrate made of a dielectric, the anode is located below the level of a cathode edge that faces towards the anode.

This makes it possible to reduce the input power of the device, increase its operating reliability, and extend much the functional capabilities of the present field-emission device.

It is preferable that a first layer of dielectric material be interposed between the anode and cathode, and that a window be made in the dielectric layer, while the cathode edge facing toward the anode serves as the emitter. This enables one to obtain a microfocused electron beam.

It is also preferable that the window provided in the dielectric layer have larger geometric dimensions than the window provided in the cathode. The anode surface in the area of the window may thus be protruding or bulging, while the cathode edge serving as the emitter may be toothed.

All the features mentioned before provide for a lower anode voltage that causes field emission of electrons, thus decreasing the input power.

It is practicable that the adjacent teeth of the cathode edge be separated by a gap, and each of the edge teeth may be connected to the cathode itself through a load resistor. Such a feature adds to the operating stability of the device.

It is advantageous to locate a layer of material which establishes, together with the material of the cathode, a Schottky barrier on the cathode surface in a close location to the edge serving as the emitter.

It is likewise practicable that a first layer of a current-conducting material be interposed between the substrate and the dielectric layer around the anode. The edges of the first layer of a current-conducting material that are situated close to the anode may be bent out towards the emitter. In addition, a second layer of a dielectric material may be applied to the cathode surface in the area of the window, with a second layer of a current-conducting material applied being placed on the second layer of a dielectric material.

As a result, a reduced anode voltage and hence a lower power consumption are attained. Moreover, the functional capabilities of the device are considerably extended.

If desired, the edges of the second layer of a current-conducting materials located in the area of the window may be bent out towards the emitter. This feature extends substantially the functional capabilities of the device, makes it possible to apply voltage to the anode and the current-conducting layer simultaneously, whereby the power consumption of the device is reduced still more.

It is also possible that a second layer of a dielectric material may be applied to the cathode surface in the area of the window and that a second layer of a current-conducting material be applied to the surface of the second layer of a dielectric material. Such an embodiment contributes to extended functional capabilities of the device, making it possible to apply voltage to the anode, the first and second current-conducting layers.

It is advantageous that a layer of a material featuring a high secondary emission ratio be applied to the anode surface, which results in an increased electron flow and hence extends the functional capabilities of the device.

It is practicable to apply a phosphor layer to the surface of the second layer of a current-conducting material in the area of the window, extending the functional capabilities of the device, making possible due to phosphor luminescence on the second current-conducting layer a display producing less harmful radiation effects.

Also, a layer of a material which has a high secondary-emission ratio may be applied to the surface of the second layer of a current-conducting material. This makes it possible to extend still further the functional capabilities of the device, that is, to provide a multistage current amplifier on the basis of the present field-emission device.

The edges of the second layer of a current-conducting material may be bent out towards the emitter, with resultant reduced power consumption of the device. Application of a phosphor layer to the anode surface is also permissible, with the result that a possibility is provided of developing displays having low harmful radiation effects.

It is advantageous that the anode in the area of the window and the substrate be made of an optically transparent material, which enables the picture to be viewed from both sides of the display screen.

A layer of a material having high luminous reflectance may be applied to the anode surface in the area of the window so as to enhance the luminescent emission of the display screen. It is also possible that the cathode edge serving as the emitter, be made of a material having negative electron affinity. Such a construction feature will reduce the power consumption of the device and add to its operating dependability.

It is possible for the substrate in the area of the window to have a recess and the anode be accommodated in that recess. Such a construction adds to the display reliability and enhances the picture quality due to balancing the luminance on the surface of a light-emitting dot. A hot (thermionic) cathode may be provided in the close vicinity of the window, adding to the display luminance due to an additional source of electrons emitted by the hot cathode.

In one embodiment of the field-emission device, the anode in the area of the window is composed of at least two semiconductor layers differing from each other in the type of conduction. This greatly extends the field of application of the device, because this embodiment of the device can be used as a highly sensitive current amplifier.

Both the anode and the cathode in the field-emission device may be shaped as ribbons which are mutually intersected and separated from one another by a dielectric layer, and window may be provided at the place of intersection of the ribbons. In this case the layer of the material establishing the Schottky barrier may be shaped as a ribbon arranged parallel to the anode ribbon. In addition, the layer of a current-conducting material may also be shaped as a ribbon situated on at least one side of the anode ribbon.

In another embodiment of the field-emission device, a plurality of anodes appear as ribbons arranged parallel to one another, and a plurality of cathodes shaped as ribbons are also arranged parallel to one another and intersecting anode ribbons so as to establish an array. This enables one to provide a display screen having high resolution, or a TV screen having high picture sharpness.

It is advantageous that the anode surface at the place of location of the windows belong to the same ribbon-type cathode and be coated by a layer of phosphor differing in the color of its luminescent emission from the adjacent one. This makes it possible to provide a high-resolution color display, a television system featuring high picture sharpness, and special-purpose equipment having high-density visual information.

It is practicable that hot cathodes may be positioned above the array surface, the cathodes appearing as filaments arranged parallel to one another and directed lengthwise the anodes. The hot cathodes add to the screen brightness.

The field-emission device of the present invention may include electronic switches operating on the basis of field emission of electrons and being situated along the perimeter of the ribbon-type anodes, cathodes, current-conducting layers and layers establishing together with the material of the cathode the Schottky barrier. Such a construction arrangement of the device is featured by a simple production technique and hence provides for reduced cost.

BRIEF DESCRIPTION OF THE DRAWINGS

In what follows the invention is illustrated by some specific exemplary embodiments thereof to be read with reference to the accompanying drawings, wherein.

DESCRIPTION OF THE PREFERRED EMBODIMENT

Figure 1:
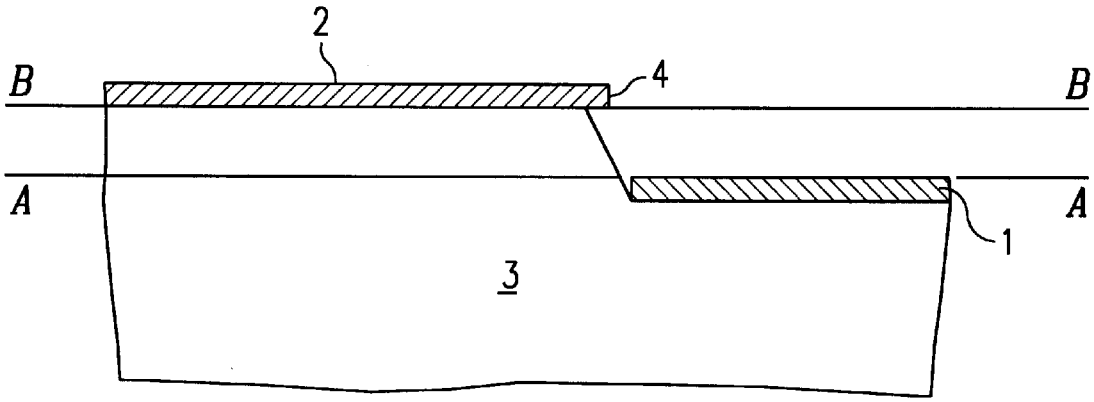
FIG. 1 is a general diagrammatic view of a simplest embodiment of a field-emission device, according to the present invention.

A field-emission device according to the present invention comprises an anode 1 (FIG. 1) and a cathode 2, both of them being placed on a substrate 3 made of a dielectric material. The level A—A at which the anode 1 is disposed must be below the level B—B at which is situated an edge 4 of the cathode which faces toward the anode 1, the edge 4 serving as the emitter. In the operative state the field-emission device is to be placed under vacuum.

The field-emission device of FIG. 1 operates as follows. A positive voltage is applied to the anode 1 with respect to the cathode 2. Due to the spacing between the anode 1 and the emitter 4, a high intensity electric field arises at the emitter 4, which provides field emission of electrons from the emitter 4 to the anode 1, and an electric current arises in the electric circuit of the anode 1. A distribution of the electron flow occurs over the whole surface of the anode 1, with the shortest flight path of the electrons being from the emitter 4 to the anode 1. The short electron flight path is due to a close spacing between the emitter 4 and the surface of the anode 1. On that account, the danger of ionization of the residual gas molecules due to their collision with electrons is low; hence, the formation of ions which could bombard the emitter 4 to change its geometry and thus to upset stability of emission, is also of low probability. This accounts for stable operation of the field-emission device with time under conditions of industrial vacuum. Distribution of the electron flow over the entire surface of the anode 1 makes it possible to prevent its local overheating at high density of field-emission current. This renders the field-emission device of FIG. 1 more reliable in operation. Construction of the field-emission device makes it possible to vary within a wide range the configuration of the anode 1, its material, or the material which coats the anode surface, thus extending considerably the field of application of the present field-emission device.

It is due to a short spacing between the emitter 4 and the anode 1 that a high-intensity electric field can be established, which accelerates the flight of electrons towards the anode 1 at low voltages applied thereto. This enables the power input of the device to be much reduced and also makes the device favorably comparable with field-emission devices known heretofore.

Application of low anode voltages also virtually avoids electric breakdown between the anode 1 and the emitter 4, which provides high operating dependability of the present field-emission device. A unique advantage of the herein-disclosed field-emission device thus resides in simple production techniques thereof and hence in the resultant low cost. The present field-emission device can find application as, e.g., a heat-and-radiation-resistant diode featuring super-high operating speed.

Figure 2:
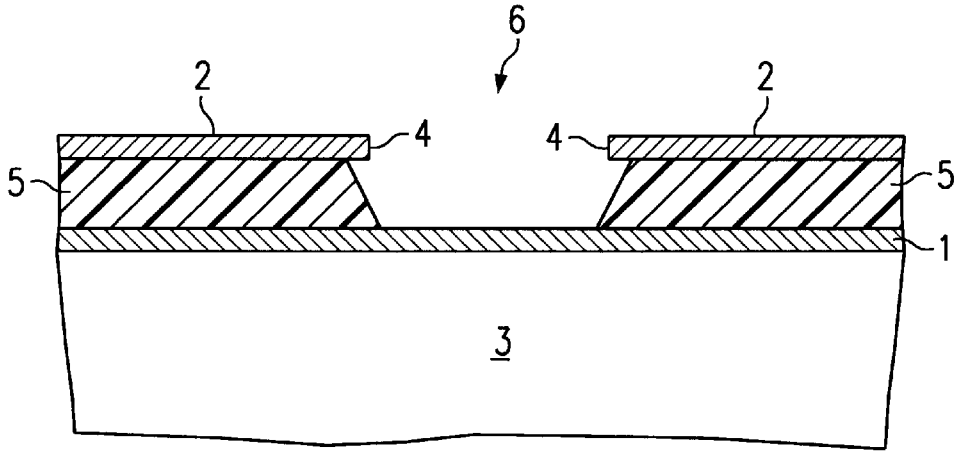
FIG. 2 is a diagrammatic view of an embodiment of a field-emission device having a window, according to the present invention.

In the field-emission device of FIG. 2 a first layer 5 of a dielectric material is interposed between the anode 1 and the cathode 2. A passage or window 6 is provided in the cathode 2 and the dielectric layer 5, while the edge of the cathode 2 which faces towards the anode 1 serves as the emitter 4. The device according to FIG. 2 features a more uniform distribution of electron flow density. This flow is emitted by the emitter 4 over the area of the surface of the anode 2 situated in the window 6. Because of the more uniform electron flow density, the surface of the anode 1 is heated more uniformly under the bombarding effect of electrons, thus ensuring higher operating dependability of the device.

Moreover, a clear advantage of such a field-emission device is a complete freedom from defocusing of the electron flow, since the area of the anode 1 bombarded by electrons is strictly defined by the dimensions of the window 6 provided in the dielectric layer 5 and in the cathode 2.

The geometrical dimensions of the window 6 (FIG. 2) made in the dielectric layer 5 may slightly exceed those of the window 6 provided in the cathode 2, with the result that the emitter 4 stands above the first dielectric layer 5. The screening effect of the first dielectric layer 5 on the emitter 4 and hence on the voltage on the anode 1 causing field emission of electrons may thus be reduced still more. In addition, electric breakdown between the emitter 4 and the anode 1 over the surface of the layer 5 becomes less probable.

Figure 3:
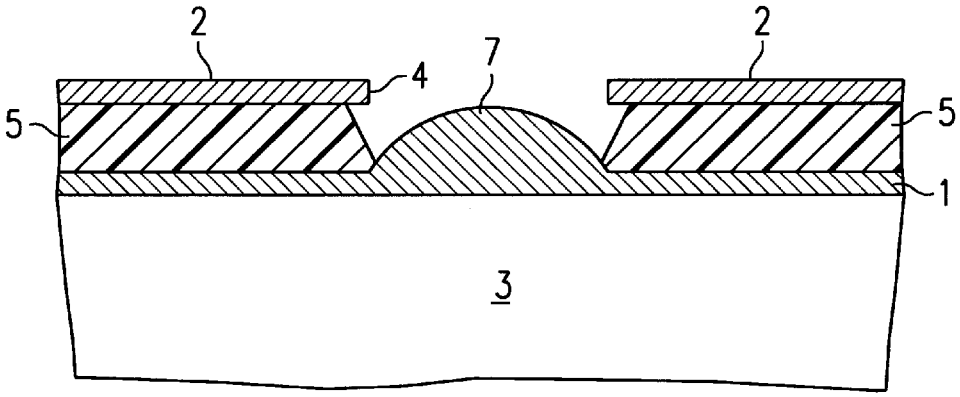
FIG. 3 is a diagrammatic view of an embodiment of a field-emission device having an anode provided with a bulge, according to the present invention.

In FIG. 3, the area of the surface of the anode 1 in the vicinity of the window 6 has a raised protrusion or surface bulge 7. Provision of the bulge 7 enables the voltage on the anode 2 to be reduced still more, this being due to a shorter interelectrode distance (that is, the spacing between the emitter 4 and the surface of the bulge 7), over which an electric field is built up to cause field emission of electrons from the emitter 4. This contributes to a higher reliability of the device and lower power consumption.

Figure 4:
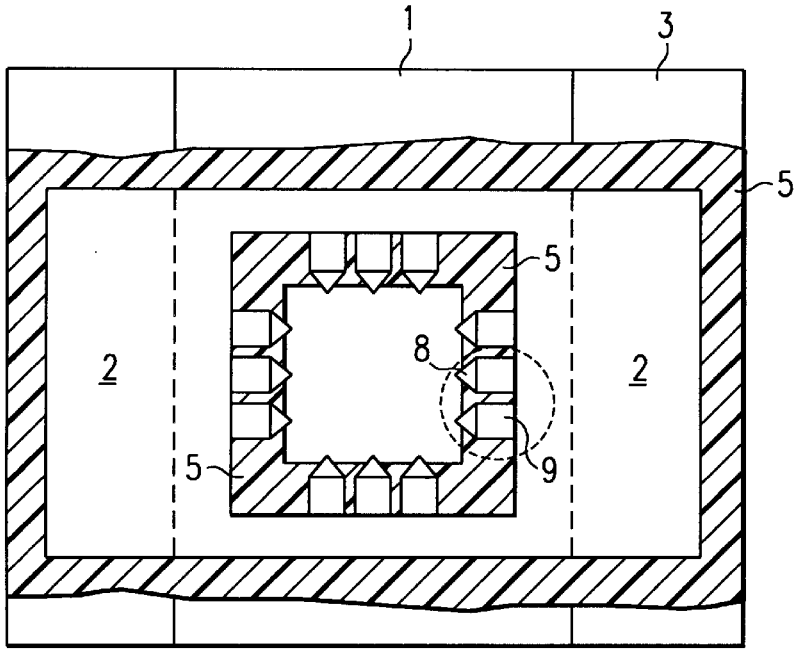
FIGS. 4 and 5 schematically illustrate an embodiment of a field-emission device provided with a toothed cathode, according to the present invention.
Figure 5:
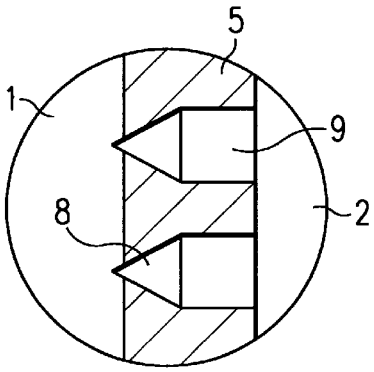
Figure 6:
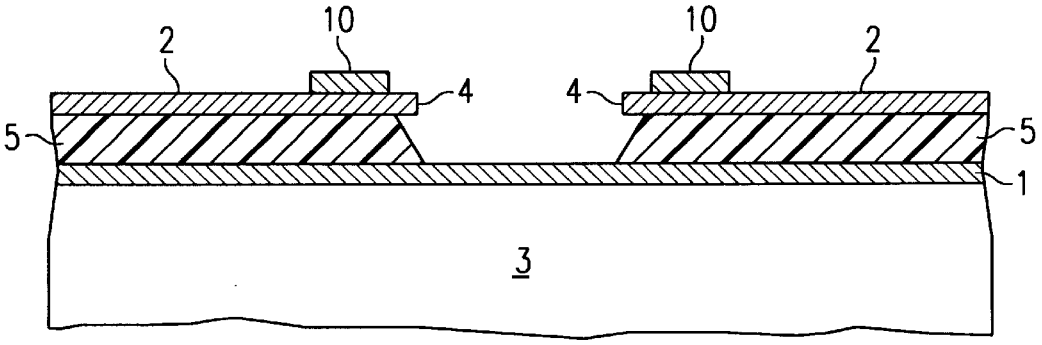
FIGS. 6, 7, 8, and 9 schematically illustrate the various embodiments of a field-emission device, making use of the Schottky effect, according to present the invention.

In addition, the field-emission device of the present invention may feature an edge of the cathode 2 serving as the emitter 4 and being toothed as indicated at 8 (FIGS. 4, 5). A gap may be provided between adjacent teeth 8, and each of the teeth 8 may be connected to the cathode 2 through a load resistor 9.

Provision of the emitter 4 in the form of the teeth 8 also reduces the voltage on the anode 1 required to cause field emission, since for the same voltage applied to the anode 1 the electric field intensity at the tooth 8 is higher than at the edge of the cathode 2 of FIGS. 1, 2, 3 serving as the emitter 4. The load resistor 9 through which the tooth 8 is connected to the cathode 2, restricts the field-emission current magnitude at which the tooth 8 might be destroyed and also smooths out current ripples on the tooth 8, whereby the present field-emission device operates more reliably.

A layer 10 of a material may be applied to the surface of the cathode 2 (FIGS. 6, 7, 8, 9) in close proximity to the edge serving as the emitter 4. The layer 10 together with the material of the cathode 2 forms a Schottky barrier. In this particular case the material from which cathode 2 is made, or least its area around the window 6, is a semiconductor, while the layer 10 forming the Schottky barrier, should be made of a metal.

When the emitter 4 is toothed (FIGS. 4, 5, 9) the layer 10 is to be applied as a thin ribbon encircling the emitter 4 so that the layer 10 does not contact the load resistor 9. When the emitter 4 is not toothed the layer 10 may be provided in the way described above, or it may be applied to the entire surface of the cathode 2 except for an area spaced somewhat apart from the edge of the cathode 2 serving as the emitter 4.

The field-emission device of FIGS. 6, 7, 8, and 9 operates as follows. A positive voltage is applied to the anode 1 with respect to the cathode 2 so as to cause field emission of electrons from the emitter 4 toward the anode 1, thus producing field-emission current in the electric circuit of the anode 1. A negative voltage is applied to the metal layer 10 with respect to the semiconductor cathode 2. The portion of cathode 2 located under the layer 10 is depleted of electrons, and conduction in that portion of the cathode 2 decreases. The current in the circuit of the anode 1 is thus reduced. With some negative voltages (−7 to −10V), conduction of cathode 2 may cease altogether, and current in the electric circuit of the anode 1 may discontinue, too. Thus, one can control the field-emission current in the electric circuit of the anode 1 till its complete discontinuation by changing the value of the negative voltage applied to the layer 10 within approximately −4 and −10V. Such low values of the control voltage provide for high stability and operating dependability of the present field-emission device, and also reduce its power consumption.

Figure 10:
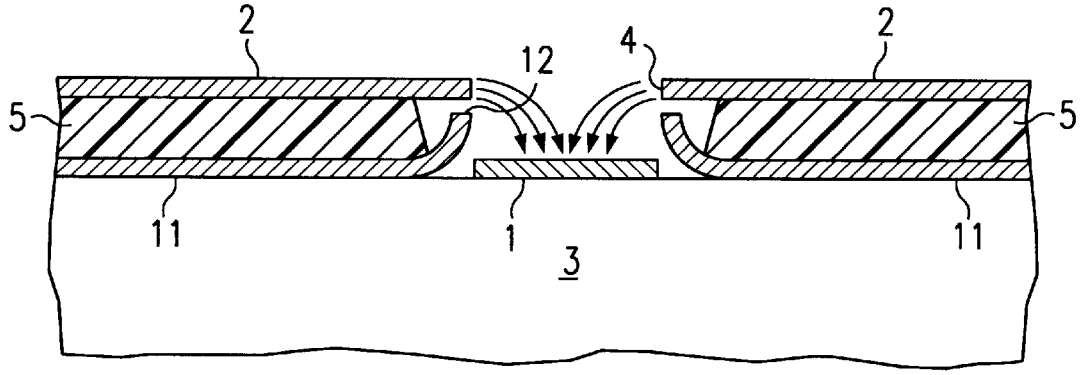
FIGS. 10, 11, and 12 schematically illustrate the various embodiments of a field-effect device, comprising layers of a current-conducting material, according to the present invention.

The field-emission device of the present invention may also comprise (FIGS. 10, 11 ) a first layer 11 of a current-conducting material, interposed between the substrate 3 and the dielectric layer 5, while edges 12 of the first layer 11 of current-conducting material which are located close to the anode 1 may be bent out towards the emitter 4.

When the cathode 2 is made of a current-conducting material (FIG. 10) the field-emission device of the present invention operates as follows. A constant positive voltage is applied to the anode 1 with respect to the cathode 2, and a positive voltage is applied to the first layer 11 of a current-conducting material with respect to the cathode 2, the value of such voltage varying within approximately 20 and 30 V. In view of a short distance between the emitter 4 and the edge 12 of the layer 11, a high-intensity electric field is established on the emitter 4 which causes field emission of electrons towards the anode 1, and an electric current arises in the anode electric circuit. The magnitude of current in the circuit of the anode 1 can be controlled by changing the voltage applied to the current-conducting material layer 11. The field-emission device of the embodiment described above can be used as an amplifier of weak electric signals arriving at the layer 11.

The cathode 2 (FIG. 11) or a portion thereof round the window 6 may be made of a semiconductor material, to which a layer 10 of material is applied, forming the Schottky barrier, applied at a distance from the edge of the cathode 2 serving as the emitter 4. This form of field-emission device operates in a way similar to that described above with the sole difference that an additional voltage can be applied to the material layer 10 to change the current flowing along the electric circuit of the anode 1 in the manner set forth above with reference to FIGS. 6, 7, 8, and 9. Thus, the field-emission device, according to FIG. 11 functions as a mixer of two electric signals one signal of which arrives upon the layer 11, and the other signal upon the layer 10. The result is that an intermediate-frequency signal can be produced in the circuit of the anode 1.

The field-emission device of the present invention may also incorporate a second layer 13 of a dielectric material applied to the surface of the cathode 2 (FIG. 12) in the area of the window 6, and a second layer 14 of a current-conducting material placed on layer 13, with edges 15 of the layer 14 situated in the area of the window 6 preferably being bent towards the emitter 4.

Figure 12:
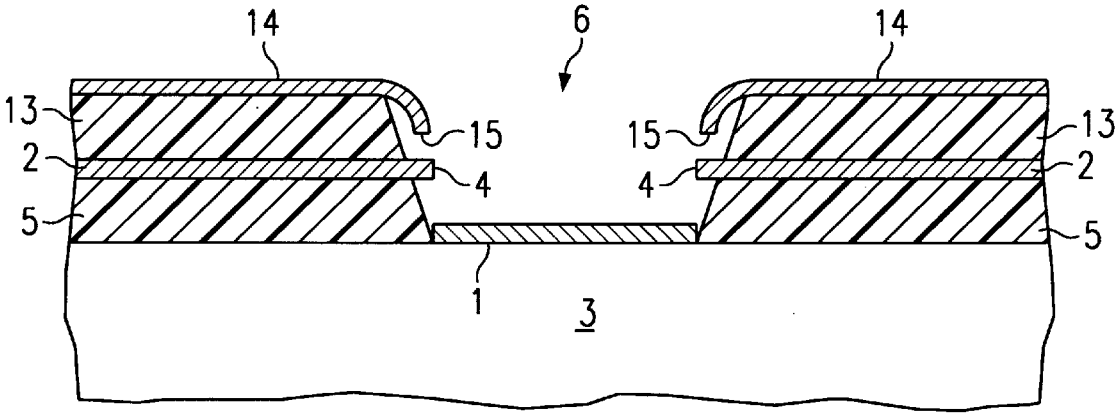

When the cathode 2 is made of metal, the field-emission device of FIG. 12 operates as follows. A positive bias is applied to the anode 1 with respect to the cathode 2, which voltage establishes a high-intensity electric field on the emitter 4, causing field emission of electrons to the anode 1.

A negative voltage is then applied to the layer 14 with respect to the emitter 4, and the intensity of the electric field decreases, and the field emission current in the electric circuit of the anode 1 is diminished. By changing the voltage applied to the layer 14 within a range between approximately −10 and −30V, one can control this field-emission current.

Figure 11:
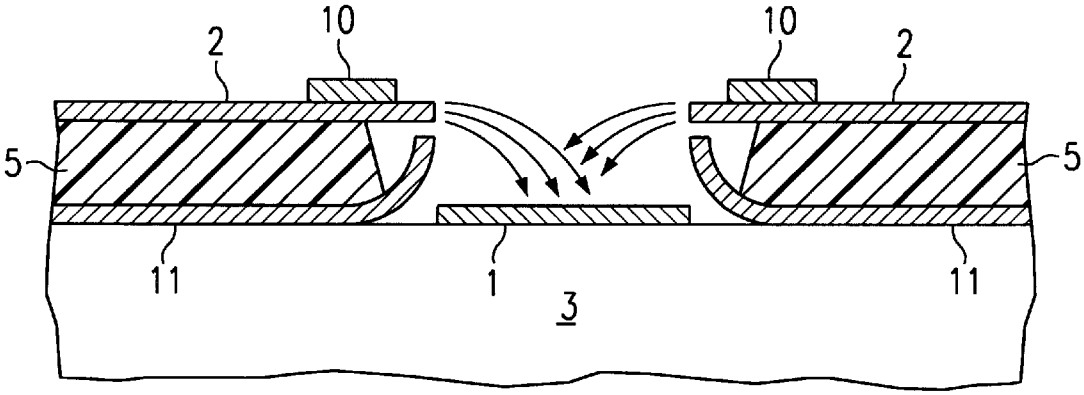

The device of FIG. 11 may be made so that when the cathode 2 (or a portion thereof located near the window 6) is made of a semiconductor material, and a layer of a material forming a Schottky barrier together with the surface of the cathode 2, is placed on the cathode surface some distance apart from the emitter 4. Such a field-emission device would operate in the manner described of FIG. 11 and function as a mixer of electric signals, one of which arrives upon the current-conducting material layer 14 and the other arriving upon the layer 10 of the other material forming the Schottky barrier.

A field-emission device of the present invention may also comprise (FIG. 13) the first layer 11 of a current-conducting material interposed between the substrate 3 and the layer 5 of a dielectric materials around the anode 1. The edges 12 of the first layer 11 located near the anode 1 may be bent out toward the emitter 4, and the second layer 13 may be made of a dielectric material applied to the surface of the cathode 2 in the area of the window 6. The second layer 14 of a current-conducting material is placed on layer 13. A first layer 16 featuring a higher secondary-emission ratio may be applied to the surface of the anode 1. The layer 16 and either a phosphor layer 17 or a second layer 17' of a material having a higher secondary-emission ratio may be applied to the surface of the layer 14 close to the window 6.

When the phosphor layer 17 is applied to the surface of the layer 14 close to the window 6, the field-emission device operates as follows. A positive voltage is applied to the anode 1 with respect to the cathode 2. A positive voltage is applied to the first layer 11 of a current-conducting materials with respect to the cathode 2, such voltage establishing, due to a short spacing (0.1–0.3 $\mu$m) between the edge 12 of the layer 11 and the emitter 4, a high-intensity electric field on the emitter 4. This causes field emission of electrons from the emitter 4 to the anode 1 on which the layer 16 is situated. While bombarding the layer 16, electrons cause secondary emission from the layer 16. There is applied a positive voltage to the second layer 14 with respect to the cathode 2, which is in excess of the voltage applied to the layer 11, with the result that the secondary electrons start bombarding the phosphor layer 17 so as to cause it to luminesce.

Figure 13:
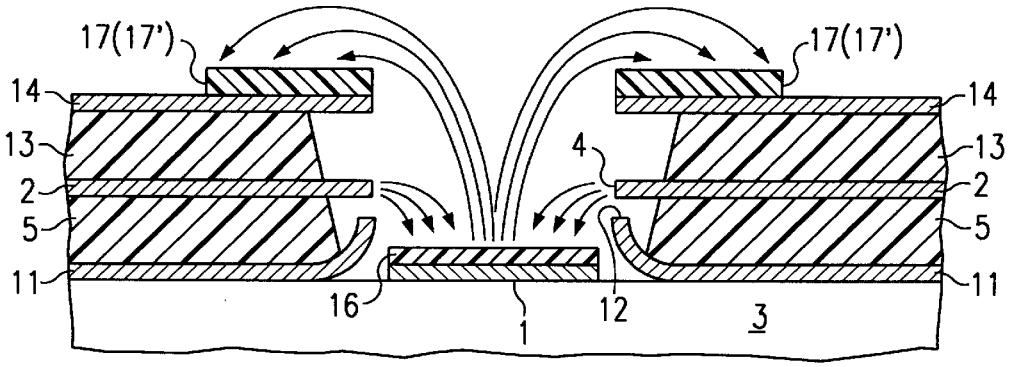
FIG. 13 illustrates the embodiments of FIGS. 10, 11, and 12 showing various versions of application of a phosphor layer and of a layer of a material having a high secondary-emission ratio, according to the present invention.

When the layer 17' having a higher secondary-emission ration is applied to the layer 14 in the area of the window 6 rather than the phosphor layer 17, the electrons bombarding the layer 17' also cause the emission of the secondary electrons therefrom. These secondary electrons may be picked up by an additional anode (not shown in FIG. 13) to which a voltage is applied that exceeds that applied to the layer 14. The field-emission device of this embodiment functions as two-stage current amplifier. Though FIG. 13 illustrates a field-emission device comprising two dielectric layers 5 and 13 and two current-conducting layers 11 and 14 which alternate, there may be many more such alternating layers, and each successive layer of current-conducting material may include a layer 17' of a material having a higher secondary-emission ratio applied to its surface in the area of the window 6, thus establishing a multistage current amplifier.

Figure 14:
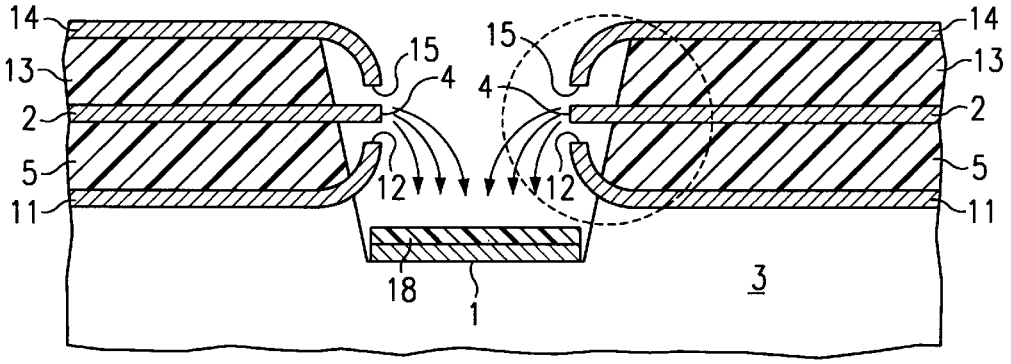
FIG. 14 is a schematic view of an embodiment of a field-emission device having a transparent anode and/or substrate, according to the present invention.
Figure 15:
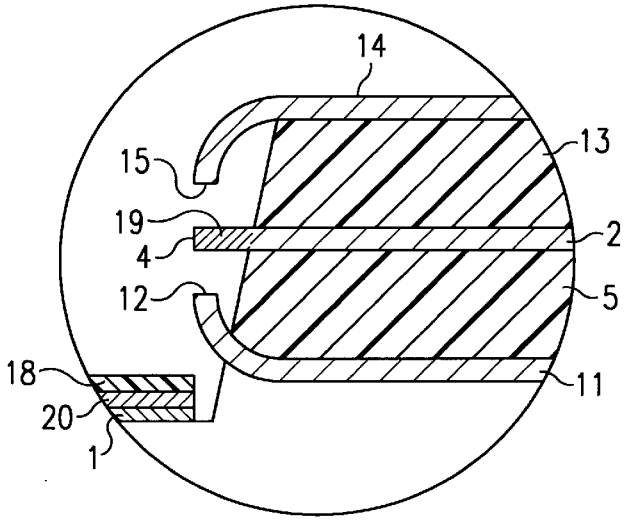
FIG. 15 is a view of FIG. 14 showing a field-emission device having a layer featuring the negative electron affinity and applied to the emitter, and another layer of a material having high luminous reflectance, according to the present invention.

The field-emission device shown in FIG. 14 may have both of the edges 12 and 15 bent out towards the emitter 4, while the anode 1 may be located in a recess in the substrate 3 and be made of a transparent current-conducting materials. A layer 18 of phosphor may be applied to the anode 1, the substrate 3 may also be made of a transparent dielectric material, and the edge of the cathode 2 serving as the emitter 4 may be coated with a layer 19 (FIG. 15) of a material having negative electron affinity.

The field-emission device of FIG. 14 operates as follows. A positive voltage is applied to the anode 1 with respect to the cathode 2, a 15–30V positive voltage is applied to the layers 11 and 14 with respect to the cathode 2 to establish a high-intensity electric field on the emitter 4, which is due to a small distance between the edges 12, 15 and the layers 11, 14, respectively. The result is field emission of electrons towards the anode 1 to which the phosphor layer 18 is applied. Upon being bombarded with electrons the phosphor layer 18 begins luminescing and its luminescence can be viewed on both sides of the transparent substrate 3.

The fact that the field-emission device has the layers 11 and 14, or either of them, makes it possible to considerably reduce the voltage causative of field emission of electrons to approximately 15–30V, and which is of paramount importance, to enhance the reliability of the field-emission device. This results from the edges 12 and 15 of the respective layers 11 and 14 being bent out towards the emitter 4. For a fixed thickness of the dielectric layers 5 and 13, the edges 12 and 15 may be brought together with the emitter 4 at a minimum distance of about 0.1–0.2 $\mu$m, and any danger of an electric breakdown of the dielectric layers 5 and 13 is in effect ruled out.

Moreover, the field of application of the field-emission device having the layers 11 and 14 is extended so that the device can be used as a mixer of electric signals, as a current-operated device, and as a picture display.

When the emitter 4 (FIG. 15) is coated with a layer 19 of a material having negative electron affinity, it is not necessary to attain high intensity (about $10^7$ V/cm) of the electric field on the surface of the layer 19, inasmuch as field emission of electrons is liable to arise in such materials at much less values of electric field intensity and hence the voltages applied to the layers 11 and 14 may be decreased considerably.

A layer 20 (FIG. 15) of a material having a high value of luminous reflectance may be applied to the surface of the anode 1 in the area of the window 6, and the phosphor layer 18 may be in turn applied to the layer 20. Application of layer 20 having high luminous reflectance provides for a reflecting effect with the phosphor layer 18 luminescing under the bombarding effect of electrons, which intensifies, as it were, the luminescent brightness of the phosphor layer 18.

The anode 1 may be situated in a recess of the substrate 3, such recess being shaped as a hemisphere, and the layer 20 of a material having high luminous reflectance, coated with the phosphor layer 18 may be applied to the anode 1. In this case, the luminescent emission of the phosphor layer 18 can be focused.

If desired, a hot cathode (not shown in the Drawings) may be provided in the close vicinity of the window 6 of the present field-emission device (FIGS. 1–15) and operate as follows. Electric current is passed through the hot cathode, which starts emitting electrons when heated. A positive voltage is applied to the anode 1 with respect to the hot cathode to accelerate electrons towards the anode 1, whereby the thermionic current arises in the anode electric circuit. When the field-emission device is made to the embodiments shown in FIGS. 1–9, a negative voltage is applied to the cathode 2 with respect to the hot cathode and the latter starts repelling the electrons, with the result that the thermionic current in the circuit of the anode 1 decreases, and may cease altogether at some values of a negative voltage applied to the cathode. Thus, one can control the field-emission current in the circuit of the anode 1.

When the field-emission device (FIGS. 10–15) comprises both of the current-conducting layers 11 and 14, or either of them, a positive voltage may applied to both of the layers 11 and 14, or to either of them, with respect to the cathode 1, causing field-emission of electrons from the emitter 4 so that the thus-emitted electrons will additionally increase field-emission current in the electric circuit of the anode 1.

When the phosphor layer 18 (FIGS. 14, 15) is applied to the anode 1, the layer is exposed to the effect of two bombarding flows of electrons, that is, both the thermionic and the field-emission ones so that the phosphor layer emits brighter luminescence.

Figure 16:
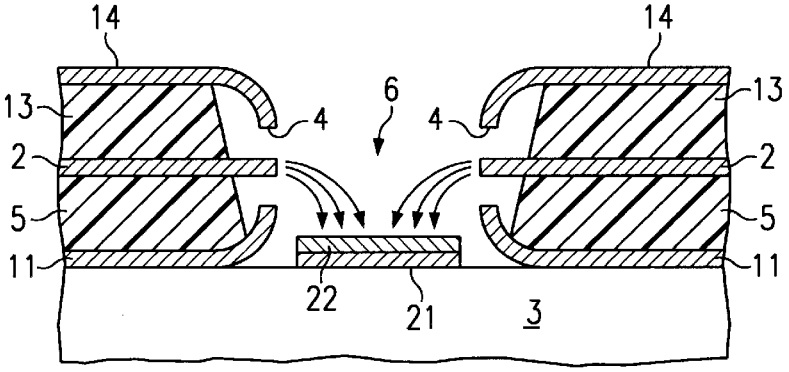
FIG. 16 is the same as FIG. 15, showing a field-effect device having the anode made up of two semiconductor layers differing in the type of conduction, according to the present invention.

The field-emission device of the present invention may have the anode 1 (FIG. 16) composed of two semiconductor layers 21 and 22 in the area of the window 6, differing in the type of conduction. Located on the substrate 3 (FIG. 16) may be a hole-conduction layer 21 (p-layer), while an electron-conduction layer 22 (n-layer) may be situated above the layer 21. A field-emission device, according to this embodiment operates as follows. A reverse (cutoff) voltage is applied to the n-p layers the from which anode 1 is made. A positive voltage with respect to the cathode 2 is applied to the layers 11 and 14 of current-conducting material, causing field emission of electrons from the emitter 4. The emitted electrons get in the accelerating electric field of the anode 1 made up of the n-p layers forming a diode, which is connected in the blocking direction. Electron-hole pairs are generated in the diode under the bombarding effect of electrons, and the pairs are disjoined by the diode intrinsic field. The result is that an electric current is generated in the diode electric circuit (i.e., the circuit of the n-p layers), the magnitude of such current being 100–1000 times that of field-emission current. The field-emission device made according to the present embodiment may be used as a highly sensitive current amplifier. Such field-emission device may also have the anode 1 made up of a number of alternating semiconductor n-p layers, or in the form of the Schottky barrier which extends the field of application of the field-emission device of the present invention.

Figure 17:
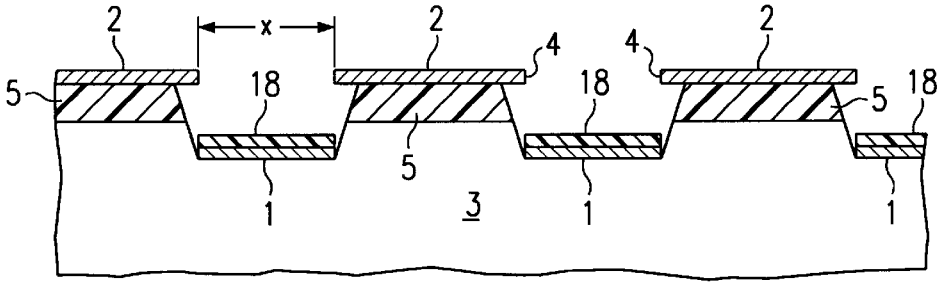
FIGS. 17, 18, 19, 20, and 21 illustrate schematically various embodiments of a field-emission device, comprising a plurality of ribbon-type anodes and a plurality of ribbon-type cathodes, which establish an array, according to the present invention.
Figure 18:
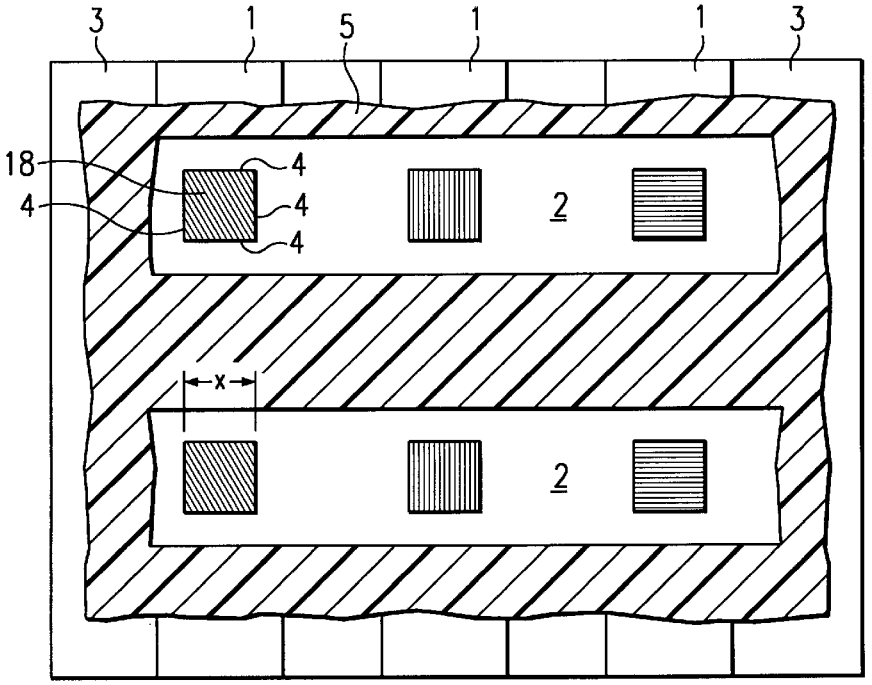

The field-emission device of the present invention may have the anode 1 and the cathode 2 shaped as ribbons (FIGS. 17 and 18) intersecting one another and isolated by the dielectric layer 5, while the windows 6 are provided at the place of intersection of the ribbons. The field-emission device may also comprise a plurality of the ribbon-type anodes 1 (FIGS. 19 and 20) arranged parallel to one another, and a plurality of the ribbon-type cathode 2 arranged also parallel to one another and intersecting the ribbon-type anodes 1, thus forming an array. Recesses may be provided in the substrate 3 at the places when the windows 6 (FIG. 21) are located, such recesses accommodating the portions of the ribbon-type anodes 1 to which the phosphor layers 18 may be applied. The substrate 3 and the portions of the ribbon-type anodes 1 located in the recesses may be made of an optically transparent material. The phosphor layers 18 located in the adjacent windows 6 and belonging to the same ribbon-type cathode 2 may differ in the color of the luminescent emission. The edge of the cathode 2 which is in fact the emitter 4, may also be toothed, and a gap may be provided between the adjacent teeth 8, each of which may be connected to the ribbon-type cathode 2 through the load resistor 9, in the manner shown in FIGS. 4 and 5.

When the ribbon-type cathodes 2 (FIGS. 17 and 18) are made of a current-conducting material, the field-emission device forming an array, operates as follows. A positive voltage is applied to one of the ribbon-type anodes 1 with respect to one of the ribbon-type cathodes 2, which voltage causes field emission of electrons at the place of their intersection from the emitter 4. The phosphor layer 18 at the place of intersection starts luminescing under the bombarding effect of the emitted electrons. Thus, by applying a positive voltage to the corresponding ribbon-type anodes 1 with respect to the corresponding ribbon-type cathodes 2 alternately at a frequency unperceivable by human eye, one can establish a monochrome (when the phosphor layer 18 is of the same color of emission on all portions of the ribbon-type anodes 1 in the windows 6), or a color luminescent picture. Brightness of the picture luminescence or that of the individual dots in the picture can be adjusted by the value of the voltage applied to the ribbon-type anodes 1. Where both the substrate 3 and the portions of the ribbon-type anodes 1 at the places of location of the windows 6 are transparent, the picture so formed can be viewed on both sides of the field-emission device shaped as an array. This novel feature of the field-emission device of the present invention renders it undoubtedly valuable from the standpoint of extending its field of application.

An extremely important advantage of this field-emission device is low capacity value of the capacitors established by the portions of the ribbon-type anodes 1 and the ribbon-type cathodes 2 at the places of their intersection. This is accounted for by the fact that the windows 6 are provided in the ribbon-type cathodes 2, much decreasing the surface overlapping the ribbon-type cathodes and the ribbon-type anodes. The transient electric processes of charging and discharging of such capacitors are thus minimized in the field-emission device of the present invention. This, in turn, enables one to turn on alternately luminescent dots having superhigh operating speed (the changeover time may be less the 1 $\mu$sec). Hence the picture being created may be composed by a great many luminescent dots, and thus feature very high sharpness, and the field-emission device may comprise approximately 2000×2000 crossovers and more arranged on the X- and Y-axes of the array, each making possible the formation of a luminescent dot. This is also promoted by the complete absence of defocusing an electron beam that causes luminescence of a single dot.

The field-emission device proposed herein may be used for a high-definition television system, as well as for developing special equipment capable of reproducing a large scope of visual information on a small array area.

Another advantage of the field-emission device of the present invention is the possibility of placing a hermetically-sealing glass directly on its surface, which simplifies much the production techniques of the device and hence reduces its cost.

It should be also understood that hot cathodes may be provided in the form of filaments situated above the surface of the array-shaped field-emission device a short distance therefrom, such filaments being arranged parallel to one another and extending lengthwise to the ribbon-type anodes 1 (FIGS. 17–21).

A field-emission device, according to such an embodiment, operates as follows. Electric current is passed through the hot cathodes thus heating them, whereby thermionic emission of electrons occurs. A positive voltage is applied to one of the ribbon-type anodes 1 with respect to the hot cathode, whereas a negative voltage is applied to all the ribbon-type cathodes. When one of the cathodes is released of a negative voltage, the shielding of electrons at the place of intersecting with deenergized ribbon-type cathode 2 by negative voltage ribbon-type anode 1 ceases, and the electrons emitted by the hot cathodes will fly towards that portion of the ribbon-type anode 1 which is situated in the window 6 of the place of intersection of the anode and cathode ribbons involved. The electrons bombard the phosphor layer 18 situated on the portion of the ribbon-type anode 1 in the window 6 and cause the phosphor layer to luminesce. Thus, a luminescent picture may be created on the present field-emission device by alternately applying a positive bias to the corresponding ribbon-type anodes 1 and disconnecting the corresponding ribbon-type cathodes 2 from a negative bias.

This construction is exhibits high reliability, since low voltage values may be applied to the ribbon-type anodes (approximately +10 to +15 V) and to the ribbon-type cathodes 2 (approximately −10 to −15V). In this case there is no necessity for reducing the spacing between the edge of the ribbon-type cathode 2 serving as the emitter 4, and the surface of the ribbon-type anode 1, inasmuch as field emission in the present field-emission device may not be used altogether.

When the ribbon-type cathodes 2 of the field-emission device (FIGS. 19 and 20) are made of a semiconductor material, there may be provided layers 10 in the form of ribbons placed on the cathode surfaces some distance apart from the end faces of the cathodes 2 and directed lengthwise the ribbon-type anodes 1. The semiconductor ribbons so placed form, together with the material of the ribbon-type cathodes 2, a Schottky barrier.

When the emitter 4 of each of the ribbon-type cathodes 2 is provided only on the two sides of the window 6 along each of the ribbon-type anodes 1, the layers 10 of the material mentioned above may be located also only on two sides of the window 6.

Figure 7:
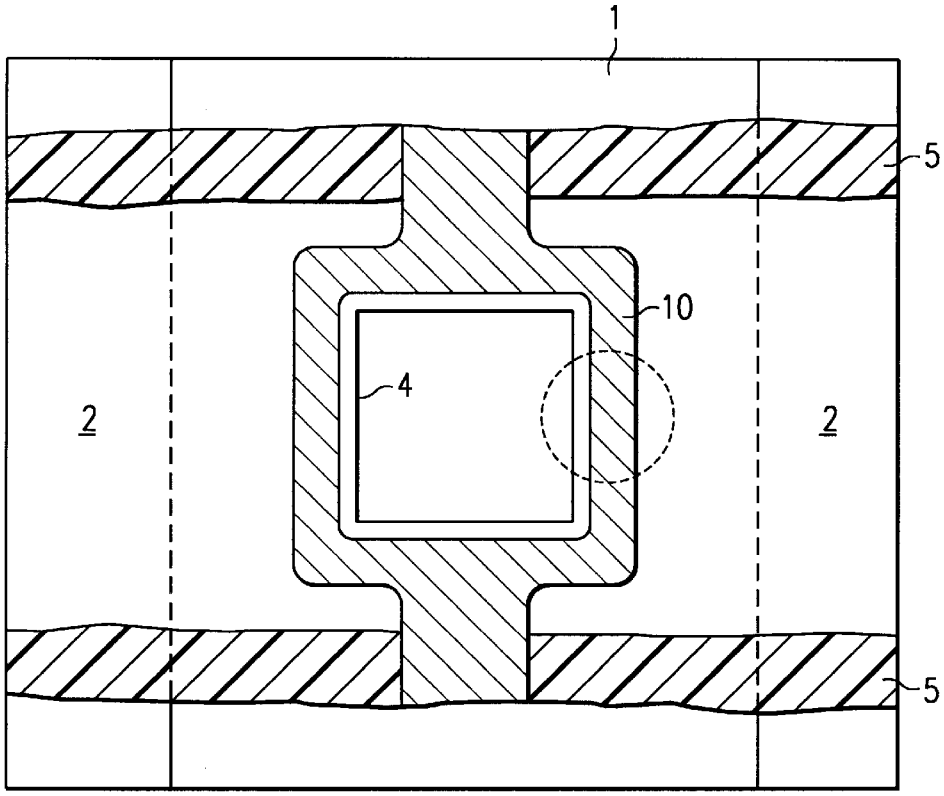
Figure 8:
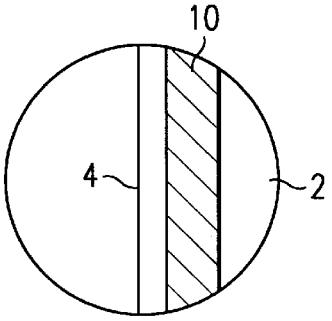

When the emitter 4 of each of the ribbon-type cathodes 2 is provided throughout the perimeter of the window 6, the layer 10 of material is arranged in the area of the window 6 as illustrated in FIGS. 7 and 8.

Figure 9:
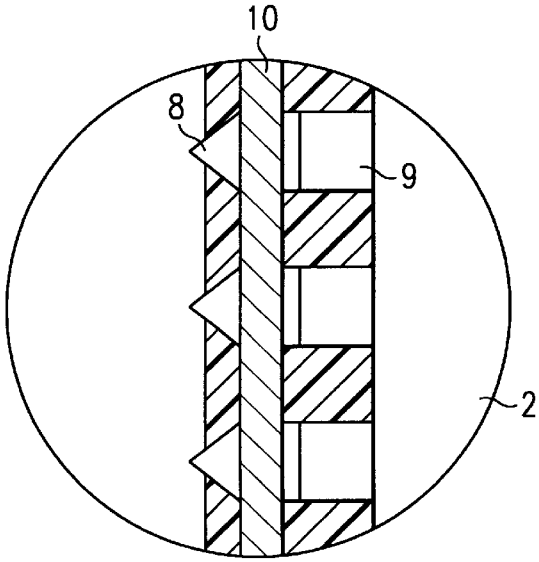

When the emitter 4 (FIGS. 4 and 5) is provided with teeth 8 and a gap is provided between the adjacent teeth 8, and each of the teeth 8 is connected to the ribbon-type cathode 2 (FIGS. 19 and 20) through the load resistor 9 (FIGS. 4 and 5), the layer 10 is arranged in the area of the window 6 as shown in FIG. 9.

Figure 19:
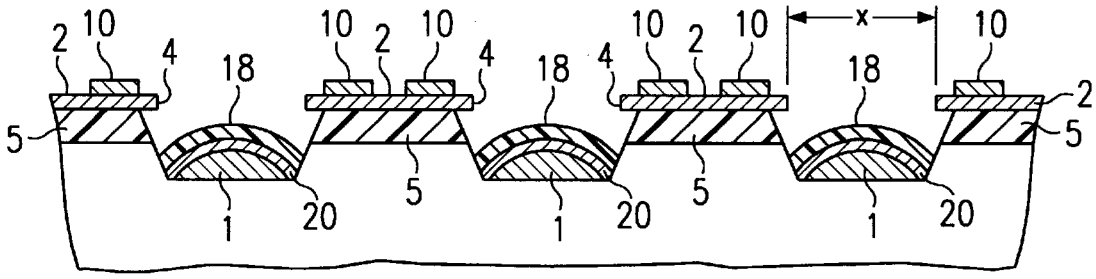
Figure 20:
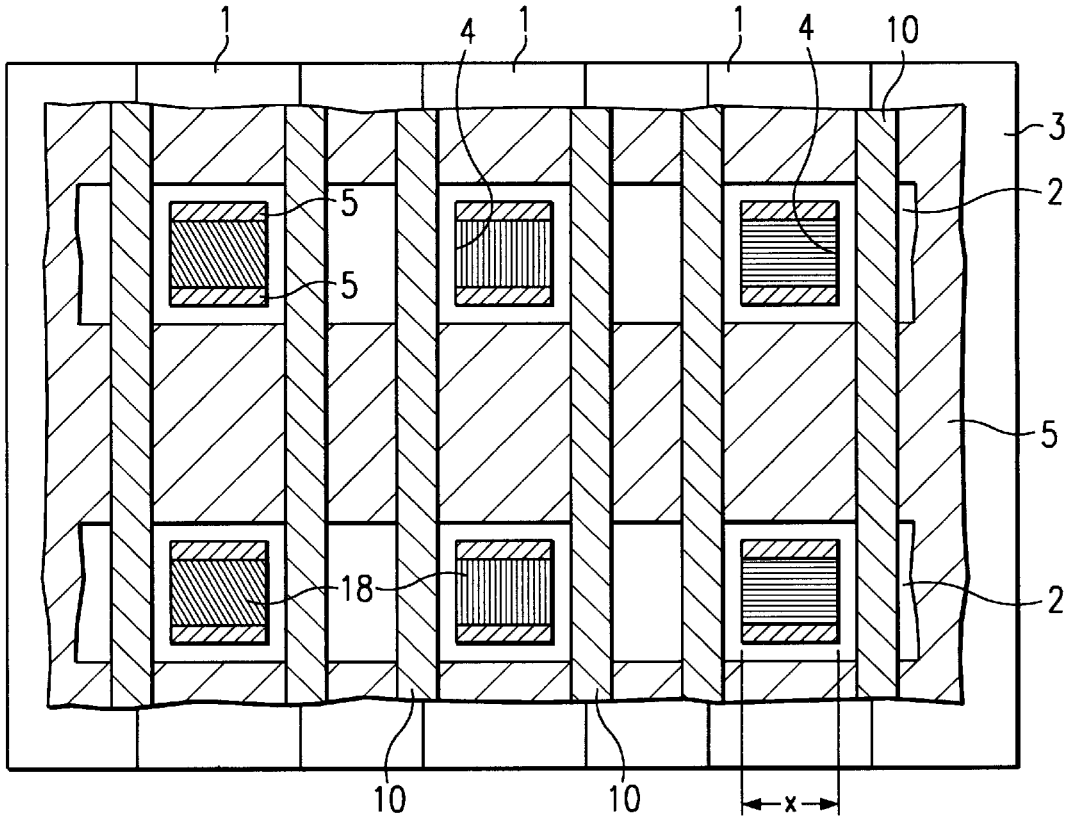
Figure 21:
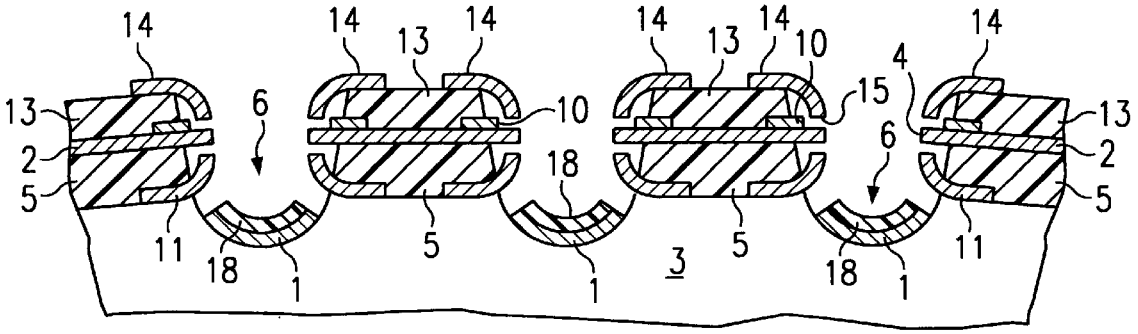

In the field-emission device presented in FIGS. 19 and 20 a constant positive voltage may be applied to each of the ribbon-type anodes 1 with respect to each of the ribbon-type cathodes 2, such voltage causing field emission of electrons from the emitter 4 and hence luminescence of the phosphor layer 18. A negative voltage may be applied to each of the ribbon layers 10 with respect to each of the ribbon-type cathodes 2.

The edges of the ribbon-made layers 11 and 14 in the area of the window 6 may be bent out toward the emitters 4. The phosphor layers 18 differing in color of luminescent emission may be located in the adjacent windows 6 belonging to the same ribbon-type cathode 2 on the surface of the anodes.

The field-emission device, according to this embodiment operates as follows. A constant positive voltage of the various values may be applied to the ribbon-type anodes 1 (FIGS. 19 and 20) with respect to the ribbon-type cathodes 2, depending on the color of luminescent emission of the phosphor layers 18 applied to the given ribbon-type anode 1. A positive voltage is applied to the ribbon layers 11 and 14 with respect to the ribbon-type cathodes 2, whereby a color picture may be created on the present field-emission device. In this particular construction of the device, with the same voltage applied the luminance of the various phosphor layers 18 is different (e.g., the green-emission phosphor layers 18 are brighter than the red and blue-emission ones, and the red-emission layers are brighter than the blue-emission ones).

Thus, the field-emission current and the brightness of the luminescent emission may be varied at the place of intersection of one of the anodes 1 (to which a positive voltage is applied) with respect to one of the cathodes 2 which intersects at this place the layer 10 of material. The variants of arrangement of the layer 10 in the area of the window 6 may be as shown in FIGS. 6–9, or in the form of two ribbons of the layer 10 as shown in FIG. 20. The luminescent emission brightness may be varied at the dots of intersection till their complete disappearance by changing the value of a negative voltage applied to the ribbon-shaped layer 10 of a material (FIGS. 6–9), or to a layer made up of two ribbons situated on both sides of the window 6 (FIG. 19).

The field-emission device shaped as an array may also comprise a plurality of parallel ribbon-shaped layers 11 and 14 (FIG. 21) made of a current-conducting material and arranged parallel to the ribbon-type anodes 1 (FIG. 21), whereby the picture color intensity is compensated.

Figure 22:
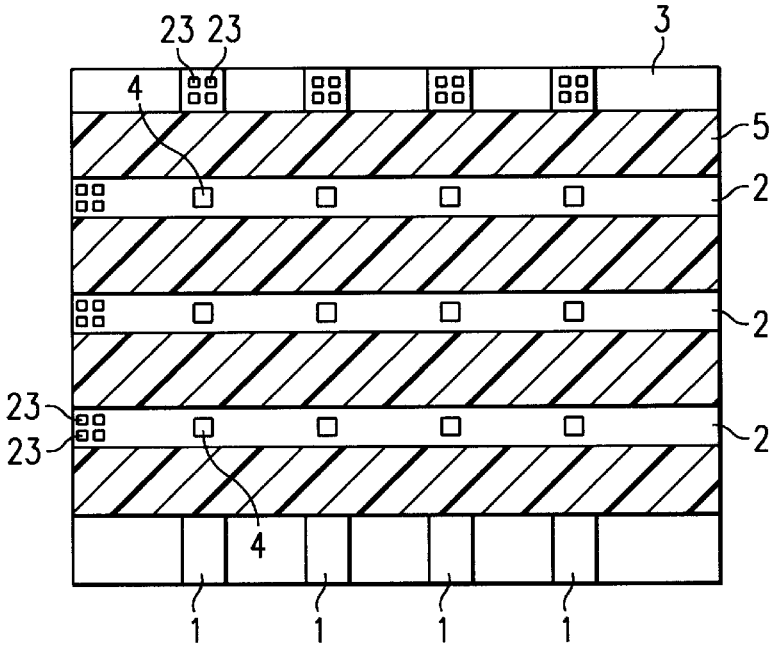
FIG. 22 represents schematically an embodiment of the field-emission device, comprising electronic switches connected to the array along the perimeter thereof, according to the present invention.

The field-emission device of the invention may also comprise electronic switches 23 (FIG. 22) situated along the perimeter of the ribbon-type anodes 1, the ribbon-type cathodes 2, the ribbon-shaped current-conducting layers 11, 14, and the ribbon-shaped layers 10, all of them operating on the concept of field emission. This to a great extent enables the production techniques of the present field-emission device to be simplified, since such electronic switches can be manufactured within the scope of a single production process, whereby an array-type field-emission device is produced, making it possible to considerably reduce its cost. In addition, the provision of the field-effect electronic switches in the array of the device enables the picture production scheme to be simplified to a great degree.

Industrial Applicability

The field-emission device herein disclosed is a fundamentally novel variety of device. Having the anode situated below the cathode emitter provides unique advantages and a broad range of functional capabilities. Among the principal of these advantages are: high operating dependability and stability due to short distances between the emitter and the electrodes, whereby high intensity of the electric field on the emitter is attained; long-term operation under conditions of industrial vacuum; low values of the negative control voltage effecting control over the emission current in the anode circuit and hence over the luminescence intensity of a phosphor layer present on the anode; no harmful radiation effects of the display due to low voltages applied; high phosphor luminescence intensity since the picture is viewed as a reflection; possibility of balancing the brightness characteristics; extremely high resolution of monochrome and color displays due to absence of defocusing the electron beams causing luminescence; simple production process techniques and hence low cost and very wide field of application of the device, which may be used as a supersensitive current amplifier, superhigh-speed mixers of signals, displays on which the picture can be viewed on both sides, and so forth; and low power consumption of any field-emission devices of the present invention.

Having described the invention above, various modifications of the techniques, procedures, material and equipment will be apparent to those in the art. It is intended that all such variations within the scope and spirit of the appended claims be embraced thereby.

I claim:

1. An edge emitter display device, comprising:

an anode having a top surface for receiving electrons;

a cathode situated at a level above the anode and laterally displaced from the top surface of the anode, the cathode providing an opening above the top surface of the anode;

the cathode having an emitting edge proximate the anode, the emitting edge operable to emit electrons when a positive voltage is applied to the anode with respect to the cathode; and a phosphor layer disposed above the top surface of the anode and below the level of the cathode, the phosphor layer operable to luminesce when struck with the electrons.

2. The device of claim 1, further comprising a first dielectric layer interposed between said anode and said cathode, the first dielectric layer having a window formed through it above the top surface of the anode, such that the window of the first dielectric layer exposes the emitting edge of said cathode.

3. The device of claim 2, further comprising a window in said cathode, and wherein said window in said first dielectric layer exceeds in dimensions said window in said cathode.

4. The device of claim 1, further comprising a layer of a material having negative electron affinity applied to said emitting edge of said cathode.

5. The device of claim 2, wherein said anode and said cathode are shaped as strips mutually intersecting at a place of intersection and separated by the first dielectric layer, and said window of the first dielectric layer being situated at the place of intersection.

6. The device of claim 1, wherein the cathode has a plurality of emitting edges proximate the anode, each of the plurality of emitting edges operable to emit electrons when a positive voltage is applied to the anode with respect to the cathode.

7. The device of claim 1, wherein the emitting edge of the cathode comprises a plurality of emitting regions.

8. The device of claim 7, wherein the plurality of emitting regions comprises adjacent teeth.

9. The device of claim 8, wherein the emitting edge of the cathode provides a gap between each of the plurality of adjacent teeth.

10. The device of claim 9, further comprising a load resistor, the load resistor coupled between the adjacent teeth and the cathode.

11. The device of claim 1, wherein the anode is optically transparent.

12. The device of claim 1, further comprising a substrate made of an optically transparent dielectric material, wherein the anode is coupled to the substrate.

13. The device of claim 1, wherein the anode comprises a surface of high luminous reflectance.

14. The device of claim 2, wherein the emitting edge of the cathode surrounds the opening above the top surface of the anode.

15. The device of claim 2, wherein the top surface of the anode comprises a bulge situated proximate the window of the first dielectric layer.

16. The device of claim 2, further comprising:

a substrate made of a dielectric material, wherein the anode is coupled to the substrate; and a current conducting layer interposed between the dielectric layer and the substrate such that a proximate edge of the current conducting layer extends between the anode and the emitting edge of the cathode.

17. The device of claim 16, wherein the proximate edge of the conducting layer is bent toward the emitting edge of the cathode.

18. The device of claim 2, further comprising:

a second dielectric layer coupled to a top surface of the cathode, the second dielectric layer providing a window of approximately the same dimensions as the window of the first dielectric layer; and a current conducting layer situated above the second dielectric layer such that a proximate edge of the current conducting layer is proximate the emitting edge of the cathode.

19. The device of claim 18, wherein the proximate edge of the current conducting layer is bent down toward the emitting edge of the cathode.

20. The device of claim 2, further comprising a substrate made of a dielectric material, the substrate having a recess, wherein the anode is coupled to the substrate at the recess.

21. The device of claim 3, wherein the emitting edge of the cathode surrounds the opening above the top surface of the anode.

22. The device of claim 5, further comprising a layer of a current conducting material shaped as a strip and situated on one side of the anode.

23. The device of claim 5, further comprising:

a plurality of anodes shaped as strips arranged substantially parallel to one another; and a plurality of cathodes shaped as strips arranged substantially parallel to one another, and intersecting the plurality of anodes shaped as strips at intersection points such that the intersection points form an array;

wherein the dielectric layer separates the plurality of anodes and plurality of cathodes, and further wherein the dielectric layer is formed to provide a window at each point of intersection.

24. The device of claim 23, further comprising a plurality of luminescent materials, disposed in a set of adjacent points of intersection along a same cathode strip, each luminescent material operable to emit a different color of light when struck with electrons.

25. The device of claim 5, further comprising a hot cathode disposed above a top surface of the array, the hot cathode operable to emit electrons when current is passed through the hot cathode.

26. The device of claim 25, wherein the hot cathode comprises a plurality of filaments situated above the top surface of the array, the plurality of filaments arranged substantially parallel the anodes shaped as strips.

27. The device of claim 5, further comprising a plurality of electronic switches located along a perimeter of the anodes shaped as strips and the cathodes shaped as strips, the plurality of electronic switches operable to respond to the electrons.

28. The device of claim 27, wherein the plurality of electronic switches comprise a plurality of field emission electronic switches.

29. The device of claim 1, further comprising a dielectric layer, wherein the anode is disposed upon the dielectric layer.

30. The device of claim 1, further comprising a substrate having a dielectric surface, wherein the anode is disposed upon the substrate.

31. The device of claim 30, wherein the cathode is disposed upon the substrate.

32. The device of claim 1, further comprising:

a substrate; and a dielectric layer, wherein the dielectric layer is disposed upon the substrate, and the anode is disposed upon the dielectric layer.

33. The device of claim 1, further comprising a layer of high luminous reflectance disposed between the anode and the phosphor layer.

34. The device of claim 1, further comprising a material disposed upon a top surface of the cathode proximate the emitting edge such that a Shottky barrier is formed.

35. The device of claim 2, further comprising a material disposed upon a top surface of the cathode proximate the emitting edge such that a Shottky barrier is formed.

36. The device of claim 5, further comprising a material disposed upon a top surface of the cathode proximate the emitting edge such that a Shottky barrier is formed, the material shaped as a strip arranged substantially parallel to the anode.

* * * * *